US012098539B2

(12) United States Patent
Zhang et al.

(10) Patent No.: US 12,098,539 B2
(45) Date of Patent: Sep. 24, 2024

(54) CONNECTION MEMBER, ALC BATTEN MOUNTING NODE STRUCTURE, AND PREFABRICATED MOUNTING METHOD

(71) Applicant: CHINA CONSTRUCTION SCIENCE AND INDUSTRY CORPORATION LTD., Guangdong (CN)

(72) Inventors: Yaolin Zhang, Guangdong (CN); Yi Sun, Guangdong (CN); Yu Zhou, Guangdong (CN); Cong Wang, Guangdong (CN); Yinan Song, Guangdong (CN); Pai Peng, Guangdong (CN); Deqiao Zhu, Guangdong (CN); Ranran Li, Guangdong (CN); Dongming Wang, Guangdong (CN)

(73) Assignee: CHINA CONSTRUCTION SCIENCE AND INDUSTRY CORPORATION LTD., Guangdong (CN)

( * ) Notice: Subject to any disclaimer, the term of this patent is extended or adjusted under 35 U.S.C. 154(b) by 341 days.

(21) Appl. No.: 17/598,635

(22) PCT Filed: Aug. 23, 2019

(86) PCT No.: PCT/CN2019/102101
§ 371 (c)(1),
(2) Date: Apr. 18, 2022

(87) PCT Pub. No.: WO2021/007921
PCT Pub. Date: Jan. 21, 2021

(65) Prior Publication Data

US 2022/0243459 A1 Aug. 4, 2022

(30) Foreign Application Priority Data

Jul. 15, 2019 (CN) ..... 201910636334.0

(51) Int. Cl.
*E04B 1/48* (2006.01)
*E04B 1/04* (2006.01)
(Continued)

(52) U.S. Cl.
CPC ..... *E04B 1/483* (2013.01); *E04B 1/043* (2013.01); *E04B 1/24* (2013.01); *E04B 1/6125* (2013.01); *E04B 2001/2481* (2013.01)

(58) Field of Classification Search
CPC .... E04F 15/14; E04B 1/41; E04B 1/38; E04B 1/24; E04B 1/483; E04B 1/043;
(Continued)

(56) References Cited

U.S. PATENT DOCUMENTS 1,484,053 A * 2/1924 Bayley ..... E04B 1/4135 52/707
2,031,249 A * 2/1936 Bowman ..... E04F 15/14 404/31
(Continued)

FOREIGN PATENT DOCUMENTS

CN 206722148 12/2017
CN 206941882 1/2018
(Continued)

OTHER PUBLICATIONS

International Search Report issued in co-pending application No. PCT/CN2019/102101 Apr. 2, 2020.

*Primary Examiner* — Paola Agudelo
(74) *Attorney, Agent, or Firm* — DINSMORE & SHOHL LLP

(57) ABSTRACT

A connecting member, an ALC batten mounting node structure, and a prefabricated mounting method are provided. The connecting member includes a connecting part, a first pipe clamp, and a second pipe clamp. The connecting part includes a first connecting segment and a second connecting
(Continued)

segment, the first pipe clamp and the second pipe clamp are respectively perpendicular to the first connecting segment, and symmetrically arranged on opposite sides of the first connecting segment, and the second connecting segment is bent towards one side of the first connecting segment.

12 Claims, 4 Drawing Sheets

(51) Int. Cl.
*E04B 1/24* (2006.01)
*E04B 1/61* (2006.01)

(58) Field of Classification Search
CPC ..... E04B 1/6125; E04B 2001/2481; E04B 5/023; E04B 5/29
USPC ... 52/319, 583.1, 584.1, 318, 333, 334, 341, 52/240, 300
See application file for complete search history.

(56) References Cited

U.S. PATENT DOCUMENTS 3,722,160 A * 3/1973 Bentley ..... E04G 21/14 52/565
4,517,776 A * 5/1985 Barker ..... E04D 12/006 52/409
5,402,616 A * 4/1995 Klein ..... B28B 23/0056 52/578
6,185,897 B1 * 2/2001 Johnson ..... E04C 5/16 52/715
7,607,272 B1 * 10/2009 Woolworth ..... E04B 2/82 52/287.1
9,359,757 B1 * 6/2016 King ..... E04B 5/023
10,167,626 B1 * 1/2019 Marwood ..... E04B 1/4178
10,619,343 B2 * 4/2020 Heady ..... B21D 35/001
2006/0137286 A1 * 6/2006 Zartman ..... E04B 1/483 52/698
2009/0158682 A1 * 6/2009 Arnold ..... E04F 15/14 52/364
2010/0011693 A1 * 1/2010 Connell ..... E04B 1/41 52/582.1
2010/0257812 A1 * 10/2010 Schultz ..... E04B 2/96 52/704
2011/0107711 A1 * 5/2011 Foley ..... E04B 1/2403 52/655.1
2012/0192506 A1 * 8/2012 King ..... E04B 1/043 52/125.4
2016/0115682 A1 * 4/2016 Evans, Jr. ..... E04B 1/388 52/698
2017/0096815 A1 * 4/2017 Parkes ..... E04F 15/14
2018/0328023 A1 * 11/2018 King ..... E04B 1/19
2021/0148109 A1 * 5/2021 Foley ..... E04B 1/043

FOREIGN PATENT DOCUMENTS

CN 108842941 11/2018
CN 108951962 12/2018
CN 109322424 2/2019
CN 208594635 3/2019
DE 3403416 8/1985

* cited by examiner

CONNECTION MEMBER, ALC BATTEN MOUNTING NODE STRUCTURE, AND PREFABRICATED MOUNTING METHOD

CROSS-REFERENCE TO RELATED APPLICATIONS

This application is a national stage filing under 35 U.S.C. § 371 of international application number PCT/CN2019/102101, filed Aug. 23, 2019, which claims priority to Chinese patent application No. 2019106363340 filed Jul. 15, 2019. The contents of these applications are incorporated herein by reference in their entirety.

TECHNICAL FIELD

The disclosure relates to the technical field of building construction, and more particularly, to a connecting member, an ALC (Autoclaved Lightweight Concrete) batten mounting node structure, and a prefabricated mounting method.

BACKGROUND

At present, prefabricated steel structure buildings are developing vigorously in China. With a large market demand, the prefabricated buildings are still the development trend of future buildings. The fabricated steel structure buildings have a very mature structure system currently, and structure safety can be fully guaranteed. The difficulties lie in the selection of three-plate parts and the connection between the three-plate parts and a main structure. A production method for a mounting detail node of an ALC batten of a wall which is one of the three-plate parts is one of the key points that directly affect a quality and a sensory feeling of a whole residential wall. The ALC batten, also known as an autoclaved aerated concrete plate, is a porous silicate product formed, by using silica sand, cement, quicklime and gypsum as raw materials, and aluminum powder as a foaming agent, through a series of technological processes (batching, reinforcement, foaming, and cutting), and finally through high temperature and high pressure steam curing, with a series of advantages including a light weight and a high strength. However, in an actual construction process, when the ALC batten is spliced and mounted, it is prone to deviation during mounting and positioning, and movement under an action of an external force, so that it is very inconvenient and inefficient to mount an ALC batten mounting node.

SUMMARY

According to the embodiments of the disclosure, a connecting member and an ALC batten mounting node structure are provided for node mounting of an ALC batten of a steel structure building, with a simple structure and firm mounting, so that a technical problem of inconvenient node mounting of the ALC batten of the steel structure building can be solved to a certain extent, and a prefabricated mounting method based on the ALC batten mounting node structure is further provided.

The technical solutions in the disclosure to solve the above technical problem are as follows.

In a first aspect of embodiments of the disclosure, a connecting member is provided, which includes a connecting part, a first pipe clamp, and a second pipe clamp, where the connecting part includes a first connecting segment and a second connecting segment, the first pipe clamp and the second pipe clamp are respectively perpendicular to the first connecting segment, and symmetrically arranged on opposite sides of the first connecting segment, and the second connecting segment is bent towards one side of the first connecting segment.

As an improvement of the above technical solution, the first pipe clamp and the second pipe clamp are positioned to be staggered with each other.

As a further improvement of the above technical solution, an included angle between the second connecting segment and the first connecting segment is a right angle.

As a further improvement of the above technical solution, the connecting part is of a plate-like structure, and the first pipe clamp and the second pipe clamp are respectively connected onto plate surfaces at two sides of the connecting part.

In another aspect of the embodiments of the disclosure, an ALC batten mounting node structure is provided for mounting a partition wall below a steel beam, which includes the connecting member according to the above technical solution, and a first ALC batten and a second ALC batten which are adjacent and connected through the connecting member. The first ALC batten and the second ALC batten are arranged below the steel beam; the first connecting segment is located between the first ALC batten and the second ALC batten which are adjacent, the first pipe clamp is embedded in the first ALC batten, and the second pipe clamp is embedded in the second ALC batten; and the second connecting segment is configured for being connected with the steel beam.

As an improvement of the above technical solution, a flexible material is filled between a top of the first ALC batten and the steel beam, and a top of the second ALC batten and the steel beam.

As a further improvement of the above technical solution, a seam is arranged between the first ALC batten and the second ALC batten, and bonding mortar is filled in the seam.

As a further improvement of the above technical solution, a gap is provided between the first connecting segment and each of the first ALC batten and the second ALC batten, and the bonding mortar is further filled in the gap.

As a further improvement of the above technical solution, the first ALC batten is provided with a convex structure at a position corresponding to the connecting member, and the second ALC batten is provided with a concave structure matched with the convex structure at a position corresponding to the connecting member.

In another aspect of the disclosure, a prefabricated mounting method based on the above ALC batten mounting node structure is provided, which includes: arranging the first ALC batten below the steel beam; mounting the connecting member on one side of the first ALC batten, embedding the first pipe clamp into the first ALC batten, and fixedly connecting the second connecting segment of the connecting member with the steel beam; and mounting the second ALC batten on one side of the first ALC batten by embedding the second pipe clamp into the second ALC batten.

As an improvement of the above technical solution, a flexible material is filled between tops of the first ALC batten and the second ALC batten, and the steel beam.

As a further improvement of the above technical solution, bonding mortar is filled in the seam between the first ALC batten and the second ALC batten.

As a further improvement of the above technical solution, when mounting a connecting plate, a gap is provided between the first connecting segment, and the first ALC batten and the second ALC batten respectively, so that the bonding mortar is capable of being filled in the gap.

The above technical solutions at least have the following advantages and beneficial effects.

By providing a connecting member including a connecting part, a first pipe clamp, and a second pipe clamp, where the connecting part includes a first connecting segment and a second connecting segment, the first pipe clamp and the second pipe clamp are respectively perpendicular to the first connecting segment, and symmetrically arranged on opposite sides of the first connecting segment, and the second connecting segment is bent towards one side of the first connecting segment; and an ALC batten mounting node structure having the connecting member, where the first connecting segment is located between a first ALC batten and a second ALC batten which are adjacent, the first pipe clamp is embedded in the first ALC batten, and the second pipe clamp is embedded in the second ALC batten and the second connecting segment is configured for being connected with the steel beam, the connecting member at a node position can be used for simultaneously fixing two adjacent ALC battens, enabling fixation to be firmer, and a mounting process to be more convenient. By providing a prefabricated mounting method based on the ALC batten mounting node structure, sequential mounting of the ALC battens can be achieved.

BRIEF DESCRIPTION OF THE DRAWINGS

In order to explain the technical solutions in the embodiments of the disclosure more clearly, the accompanying drawings needing to be used in description of the embodiments are briefly described hereinafter.

DETAILED DESCRIPTION

This part will describe the specific embodiments of the disclosure in detail, and some embodiments of the disclosure are shown in the accompanying drawings. The accompanying drawings are used to supplement the description of the text in the description with the graphs, so that people can intuitively and vividly understand each technical feature and the overall technical solution of the disclosure, but the accompanying drawings cannot be understood as limiting the scope of protection of the disclosure.

In the description of the disclosure, the orientation or position relationship indicated by the terms "up", "down", "front", "rear", "left", "right", and the like is based on the orientation or position relationship shown in the accompanying drawings, it is only for the convenience of description of the disclosure and simplification of the description, and it is not to indicate or imply that the indicated device or element must have a specific orientation, and be constructed and operated in a specific orientation. Therefore, the terms shall not be understood as limiting the disclosure. If some feature is called "arranged", "fixed", and "connected" on another feature, the feature may be directly set, fixed or connected to another feature, or indirectly set, fixed, and connected on another feature.

In the description of the disclosure, the meaning of "several" refers to be one or more, and the meaning of "a plurality of" refers to be two or more. The meanings of "greater than", "less than", "more than", and the like should be understood as not including this number, while the meanings of "above", "below", "within", and the like should be understood as including this number. The terms "first" and "second" should be understood as being used for distinguishing the technical features only in the description, and cannot be understood as indicating or implying relative importance, implicitly indicating the number of technical features indicated thereby, or implicitly indicating the order of technical features indicated thereby.

In addition, unless otherwise defined, all technical and scientific terms used in the disclosure have the same meanings as those commonly understood by person of ordinary skill in the art. The terms used in the disclosure are only used for describing specific embodiments, and are not intended to limit the disclosure.

Embodiment 1

Figure 1:
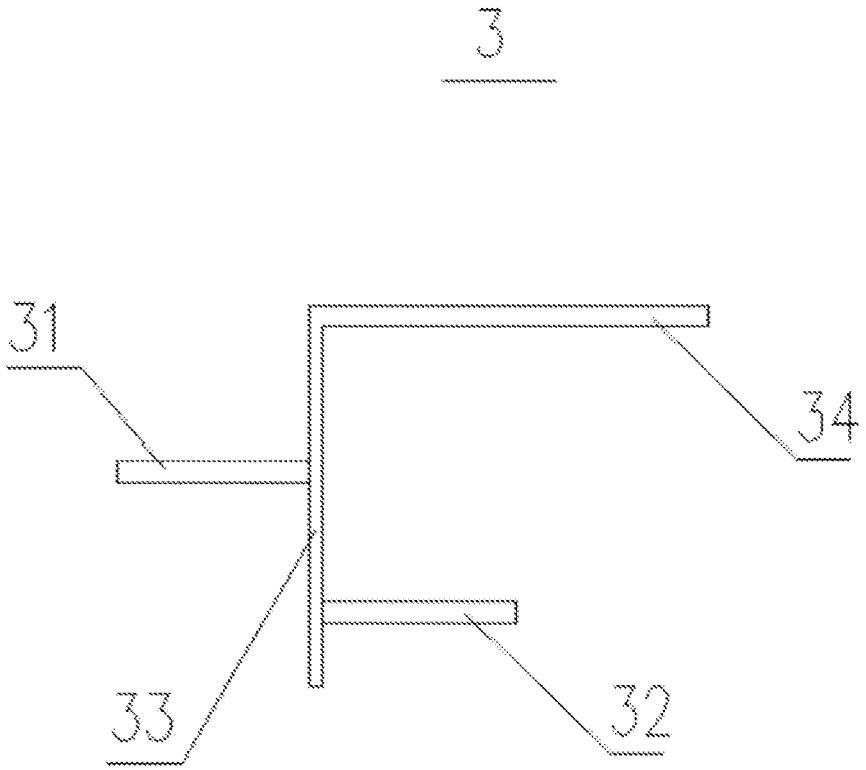
FIG. 1 is a front view of a connecting member according to an embodiment.
Figure 2:
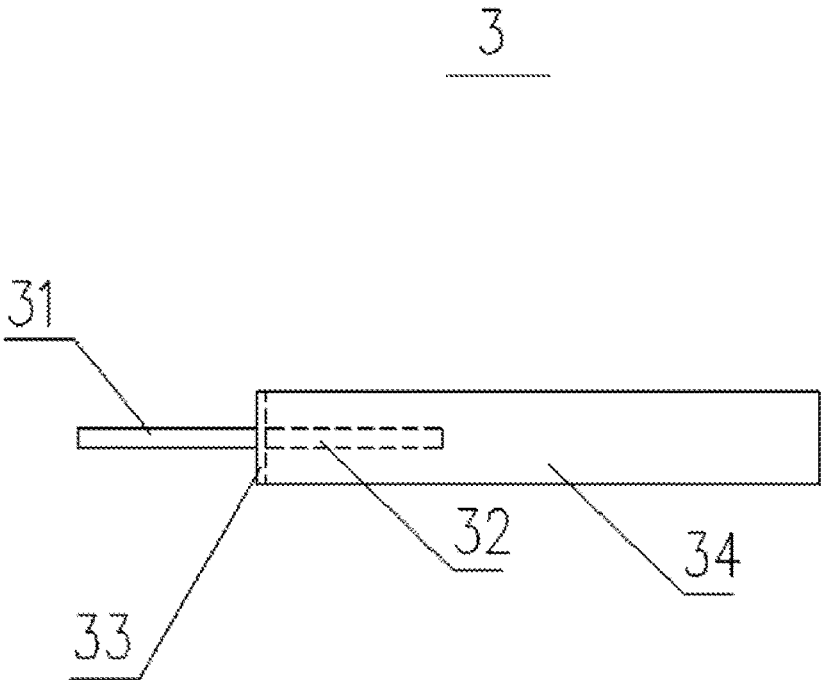
FIG. 2 is a top view of the embodiment shown in FIG. 1.

FIG. 1 is a front view of a connecting member according to an embodiment, and FIG. 2 is a top view of the embodiment shown in FIG. 1. With reference to both FIG. 1 and FIG. 2, the connecting member 3 according to an embodiment of the disclosure includes a connecting part, a first pipe clamp 31, and a second pipe clamp 32. The connecting part includes a first connecting segment 33 and a second connecting segment 34, and the first pipe clamp 31 and the second pipe clamp 32 are respectively perpendicular to the first connecting segment 33, and symmetrically arranged on opposite sides of the first connecting segment 33 to form the connecting member 3 of a double-sided pipe clamp structure. Therefore, an ALC batten mounting node can be mounted conveniently by using the connecting member. The first connecting segment 33 is located between two adjacent ALC battens, the first pipe clamp 31 and the second pipe clamp 32 of the connecting member 3 are respectively connected with the two adjacent ALC battens, so as to achieve the effect of using the connecting member 3 on a node position for simultaneously fixing the two adjacent ALC battens, enable fixation to be firmer, and enable a mounting process to be more convenient. Specific ALC batten mounting node and a mounting process will be described in detail hereinafter, and only structural arrangement of the connecting member 3 is described here.

In implementation, the first pipe clamp 31 and the second pipe clamp 32 may be positioned to be staggered with each other to disperse stress. For example, in the embodiment shown in FIG. 1, the first pipe clamp 31 and the second pipe clamp 32 are staggered longitudinally.

The second connecting segment 34 is bent towards one side of the first connecting segment 33, which is convenient to be fixedly connected with an upper mounting structure of the ALC batten, so that the ALC batten can be fixedly connected at a required position. According to a connection requirement, an included angle between the second connecting segment 34 and the first connecting segment 33 is set as required, in the embodiment, the included angle between the second connecting segment 34 and the first connecting segment 33 is a right angle, and the second connecting segment and the first connecting segment can be connected onto a steel beam above the ALC batten, thus being suitable for an internal or external partition wall below the steel beam, and convenient and firm in connection.

Specifically, the connecting part may be of a plate-like structure, which is beneficial for reducing a width of a seam between the adjacent ALC battens, and enables a seaming position to be more flat. The first pipe clamp 31 and the second pipe clamp 32 are respectively connected onto plate surfaces on two sides of the first connecting segment 33, and the first connecting segment 33 and the second connecting segment 34 may be formed by bending a same plate member, or splicing and connecting two plate members.

Embodiment 2

Figure 3:
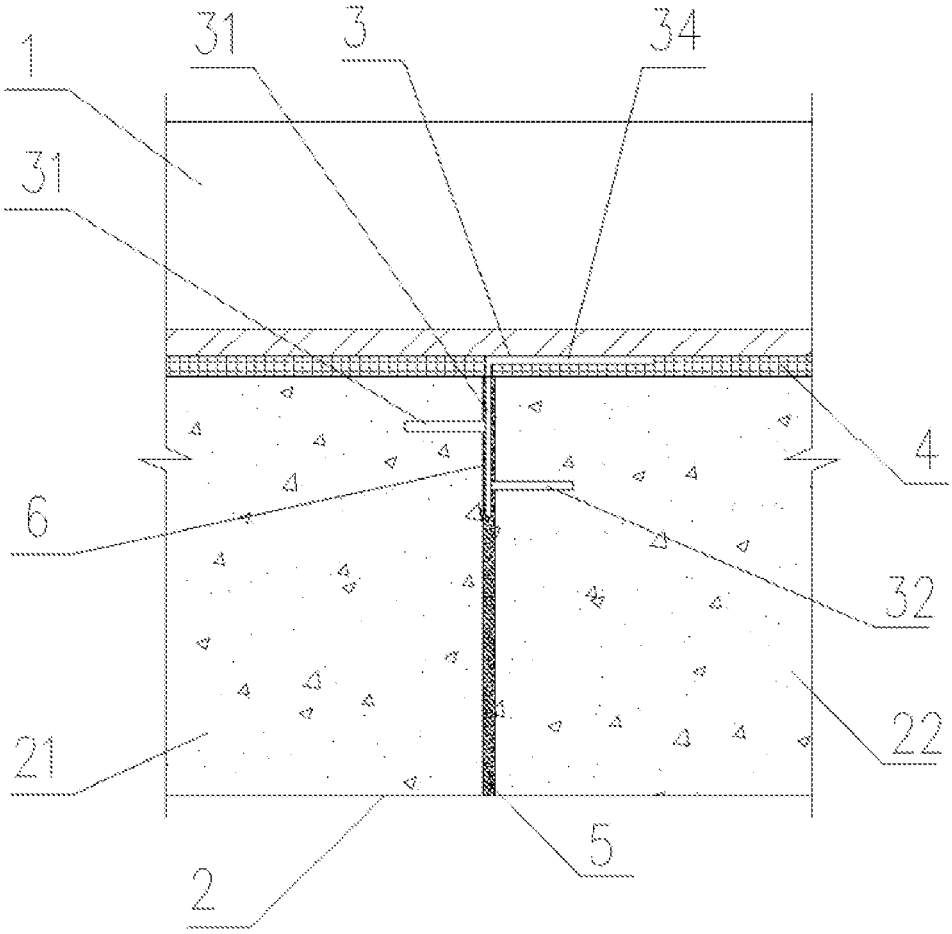
FIG. 3 is a schematic structural diagram of an ALC batten mounting node structure according to an embodiment.
Figure 4:
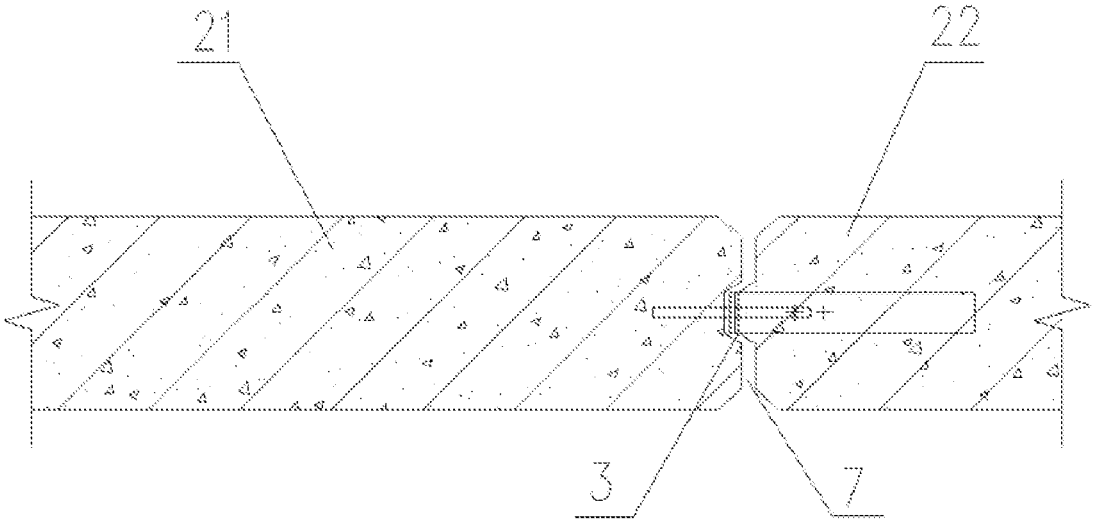
FIG. 4 is a schematic structural diagram of adjacent ALC battens and the connecting member according to an embodiment.
Figure 5:
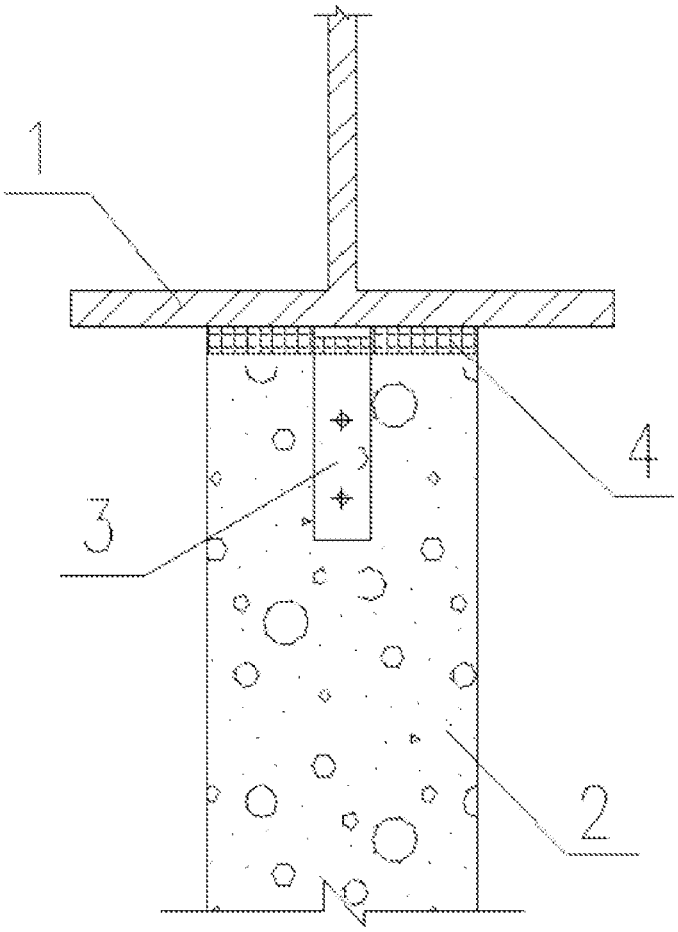
FIG. 5 is a cross-section view of the ALC batten mounting node structure according to an embodiment.

FIG. 3 is a schematic structural diagram of an ALC batten mounting node structure according to an embodiment, FIG. 4 is a schematic structural diagram of adjacent ALC battens and the connecting member 3 according to an embodiment, and FIG. 5 is a cross-section view of the ALC batten mounting node structure according to an embodiment. With reference to FIG. 3 to FIG. 5, and in combination with the above description of the connecting member 3, the ALC batten mounting node structure according to an embodiment of the disclosure may be used for mounting a partition wall below the steel beam 1, the ALC batten mounting node structure includes the steel beam 1, the above connecting member 3, and the adjacent ALC battens 2 connected through the connecting member 3. The adjacent ALC battens 2 are respectively defined as a first ALC batten 21 and a second ALC batten 22, and the first ALC batten 21 and the second ALC batten 22 are arranged below the steel beam 1. The first connecting segment 33 is located between the first ALC batten 21 and the second ALC batten 22 which are adjacent, the first pipe clamp 31 is embedded in the first ALC batten 21, and the second pipe clamp 32 is embedded in the second ALC batten 22. The second connecting segment 34 is configured for being connected with the steel beam 1, and may be fixedly connected with the steel beam 1 by welding, and the second connecting segment 34 is welded on a lower flange plate of the steel beam 1, and is hidden in a top surface of the ALC batten. Therefore, in combination with a structure of the above connecting member 3, it can be known that in the ALC batten mounting node structure, the two adjacent ALC battens can be fixedly connected at the same time through a single connecting member 3, and can be fixedly connected onto the steel beam 1 through the second connecting segment 34 of the connecting member 3, which is simple in structure, and can implement prefabricated mounting, so that the mounting is convenient and firm, and a technical problem of inconvenient node mounting of the ALC batten of a steel structure building can be solved.

A flexible material 4, such as a foaming adhesion agent, is filled between tops of the first ALC batten 21 and the second ALC batten 22, and the steel beam 1, thus forming flexible connection. A seam is arranged between the first ALC batten 21 and the second ALC batten 11, and bonding mortar 5 is filled in the seam. In specific implementation, a certain distance is kept when the first pipe clamp 31 and the second pipe clamp 32 are inserted into the first ALC batten 21 and the second ALC batten 22, so that a gap 6 is provided between the first connecting segment 33, and the first ALC batten 21 and the second ALC batten 22. When the bonding mortar 5 is filled in the seam, the bonding mortar 5 is also filled in the gap 6.

In the embodiment, the first ALC batten 21 is provided with a concave structure 211 at a position corresponding to the connecting member 3, and the second ALC batten 22 is provided with a convex structure 221 matched with the concave structure 211 at a position corresponding to the connecting member 3, so that a seam 7 with an irregular cross section is formed at a seaming position of the adjacent ALC battens, which is beneficial for increasing a connecting area of the adjacent ALC battens, and improving a stability at a connecting position of the seam.

The patent NON-WELDING FLEXIBLE STEEL BEAM CLAMPING MEMBER FOR ALC BATTEN INTERIOR WALL AND U-SHAPED CLAMP NODE STRUCTURE with publication No. CN206941882U provides a non-welding flexible steel beam clamping member for an ALC batten interior wall and a U-shaped clamp node structure in a prefabricated steel structure building. The steel beam clamping member is formed by bending a steel plate, and a clamping groove matched with the steel beam is arranged on the steel beam clamping member. Inner sides of bent parts on two sides of the clamping groove are both provided with a clamping limiting protrusion, and an outer bottom surface of a middle part of the steel beam clamping member is a welding connection surface of the U-shaped clamping member.

The technical solutions provided by the patent application have the following disadvantages.

1. The patent only puts forward details of a node of a U-shaped clamp, without describing an application scope in detail. If a width of an ALC wall is less than a width of a beam flange plate, a width of the U-shaped clamp is reduced correspondingly, and then whether the clamping limiting protrusion may still be applied is uncertain.

2. A whole U-shaped clamp device is connected with the flange plate by the clamping limiting protrusion, and a connection strength is not guaranteed.

According to the ALC batten mounting node structure and the connecting member 3 provided by the embodiment of the disclosure, the connecting member 3 with double-sided pipe clamps is mounted in a vertical seam between two ALC battens 2, and the pipe clamps on two sides of a connecting plate directly extend into mounting holes in side surfaces of the prefabricated ALC battens 2, so that the pipe clamps at one node position fix the two adjacent ALC battens 2 at the same time. The second connecting segment 34 of the connecting member 3 is bent at the top of the ALC batten and welded on the lower flange plate of the steel beam 1, and is hidden in the top surface of the ALC batten, so that a finished surface of the wall is more beautiful and integrated, thus being suitable for mounting ALC battens of all thicknesses, being capable of optimizing construction sequence and method of the ALC battens, and improving a mounting accuracy of the battens.

Embodiment 3

Figure 6:
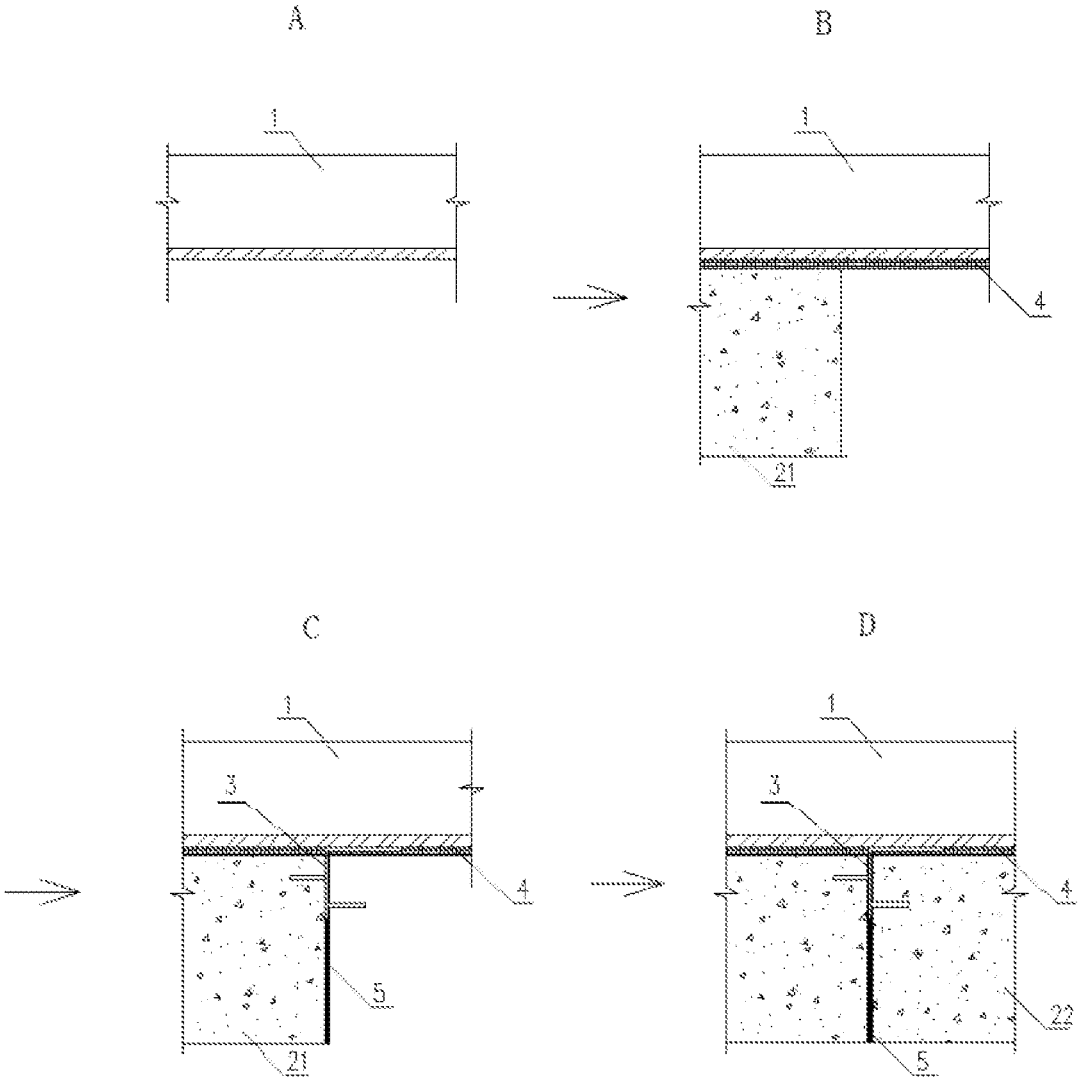
FIG. 6 is a sequence diagram of a prefabricated mounting method of an ALC batten mounting node according to an embodiment.

According to an embodiment of the disclosure, there is further provided a prefabricated mounting method based on the above ALC batten mounting node structure. FIG. 6 is a sequence diagram of the prefabricated mounting method of an ALC batten mounting node according to an embodiment. In combination with the above ALC batten mounting node structure, and with reference to FIG. 6 in which a mounting sequence A-B-C-D is shown, the method is described as follows.

The first ALC batten is arranged below the steel beam.

The connecting member is arranged on one side of the first ALC batten, the first pipe clamp is embedded in the first ALC batten, and the second connecting segment of the connecting member is fixedly connected with the steel beam.

The second ALC batten is mounted on one side of the first ALC batten, so that the second pipe clamp is embedded in the second ALC batten. Mounting holes may be arranged in the ALC battens at corresponding positions in advance to facilitate insertion and mounting of the first pipe clamp or the second pipe clamp during mounting.

According to the above mounting method, the ALC battens at the ALC batten mounting node are mounted in sequence, one of the ALC battens may be measured and positioned first, then the connecting member is mounted and fixed, and then the other ALC batten is mounted on the other side of the connecting member, thus effectively preventing deviation or displacement of the ALC battens during mounting, improving a mounting accuracy, ensuring a flush mounting surface, and having strong operation and implementation.

A flexible material, such as a foaming adhesion agent, is filled between tops of the first ALC batten and the second ALC batten, and the steel beam, thus forming flexible connection. The bonding mortar is filled in the seam between the first ALC batten and the second ALC batten. When a connecting plate is mounted, a certain distance is kept when the first pipe clamp and the second pipe clamp are inserted into the first ALC batten and the second ALC batten, so that a gap is provided between the first connecting segment, and the first ALC batten and the second ALC batten respectively, so that the bonding mortar is capable of being filled in the gap, which is beneficial for improving a stability at the connecting position.

Positioning method of the first ALC batten may use a conventional way of plumb bob paying-off. A required positioning line is arranged according to a designed position on the ground and wall and top surfaces, and the first ALC batten is positioned and arranged according to the positioning line.

The patent application CONSTRUCTION METHOD FOR PREFABRICATED PARTITION WALL BASED ON ALC BATTEN with publication No. CN106499091A provides a construction method for a prefabricated partition wall based on an ALC batten. The batten is mounted by manual transverse and longitudinal compaction, which is beneficial for combining an adhesion agent with a plate and a concrete surface, and ensures that there is no large stress on a wall and a seaming position after curing and shrinkage of the adhesion agent, so that a possibility of cracks on the wall and the seaming position is greatly reduced. During construction, mounting of the ALC batten is further adjusted and calibrated, thus improving a forming quality of the wall.

The technical solutions provided by the patent application have the following disadvantages.

1. The mounting method using manual transverse and longitudinal compaction for combining the adhesion agent with the plate and the concrete surface is inefficient, and the manual compaction cannot guarantee uniform adhesive force and gap between bonding surfaces, thus being poor in forming.

2. There is no fastener for fixing the ALC batten in the construction method, which is prone to deviation during mounting and positioning, especially prone to movement under an action of an external force of the manual compaction.

In some of other conventional structures and solutions, a U-shaped clamp is used to fix a top end of the batten. The U-shaped clamp is fixed on structural beam and plate in the seam between the top ends of two battens through a nail gun.

According to the ALC batten mounting node structure and the prefabricated mounting method based on the ALC batten mounting node structure provided by the embodiments of the disclosure, sequential mounting can be implemented. An ALC batten on an edge of an end part is positioned below the steel beam first, then the connecting member is mounted, and then the next ALC batten is mounted. The connecting member is provided with double-sided pipe clamps, an adjacent ALC batten may be directly inserted into the pipe clamp on an opposite side according to the position of the pipe clamp, and the sequential mounting is implemented in a sequence of "ALC batten—connecting member—ALC batten", so that the mounting method is simple and easy to operate, improving mounting efficiency and guaranteeing the flatness of a wall appearance. Moreover, the fixation is firm by the fixing method, and one connecting member may fix two ALC battens at the same time, which enables the fixation of the battens to be more stable and improves a stability of the structure, thus being suitable for all prefabricated buildings with a steel structure as a main body and the ALC batten as the partition wall. For example, buildings with a steel structure as a main frame and an I-shaped structural steel beam, such as a residential building and a commercial building, are widely popularized.

The above is only some embodiments of the disclosure, but the disclosure is not limited to the above embodiments. A person of ordinary skill in the art may further make multiple equivalent modifications or substitutions without violating the gist of the disclosure, and these equivalent modifications or substitutions are all included in the scope defined by the claims of the present application.

What is claimed is:

1. An ALC batten mounting node structure for mounting a partition wall below a steel beam, comprising a connecting member, a first ALC batten and a second ALC batten which are adjacent and connected through the connecting member, wherein the connecting member comprises a connecting part, a first pipe clamp, and a second pipe clamp, wherein the connecting part comprises a first connecting segment and a second connecting segment, the first pipe clamp and the second pipe clamp are respectively perpendicular to the first connecting segment, and symmetrically arranged on opposite sides of the first connecting segment, and the second connecting segment is bent towards one side of the first connecting segment, wherein the first ALC batten and the second ALC batten are arranged below the steel beam; the first connecting segment is located between the first ALC batten and the second ALC batten which are adjacent, the first pipe clamp is embedded in the first ALC batten, and the second pipe clamp is embedded in the second ALC batten; and the second connecting segment is configured for being connected with the steel beam.

2. The ALC batten mounting node structure of claim 1, wherein a flexible material is filled between tops of the first ALC batten and the second ALC batten, and the steel beam.

3. The ALC batten mounting node structure of claim 1, wherein a seam is arranged between the first ALC batten and the second ALC batten, and bonding mortar is filled in the seam.

4. The ALC batten mounting node structure of claim 3, wherein a gap is provided between the first connecting segment and each of the first ALC batten and the second ALC batten, and the bonding mortar is further filled in the gap.

5. The ALC batten mounting node structure of claim 1, wherein the first ALC batten is provided with a convex structure at a position corresponding to the connecting member, and the second ALC batten is provided with a concave structure matched with the convex structure at a position corresponding to the connecting member.

6. A prefabricated mounting method based on the ALC batten mounting node structure of claim 1, comprising:

arranging and positioning the first ALC batten below the steel beam;

mounting the connecting member on one side of the first ALC batten, embedding the first pipe clamp into the first ALC batten, and fixedly connecting the second connecting segment of the connecting member with the steel beam; and mounting the second ALC batten on one side of the first ALC batten by embedding the second pipe clamp into the second ALC batten.

7. The prefabricated mounting method based on the ALC batten mounting node structure of claim 6, further comprising: filling a flexible material between tops of the first ALC batten and the second ALC batten, and the steel beam.

8. The prefabricated mounting method based on the ALC batten mounting node structure of claim 6, further comprising: filling bonding mortar into a seam between the first ALC batten and the second ALC batten.

9. The prefabricated mounting method based on the ALC batten mounting node structure of claim 8, wherein when mounting a connecting plate, a gap is provided between the first connecting segment and each of the first ALC batten and the second ALC batten, so that the bonding mortar is capable of being filled in the gap.

10. The ALC batten mounting node structure of claim 1, wherein the first pipe clamp and the second pipe clamp are positioned to be staggered with each other.

11. The ALC batten mounting node structure of claim 1, wherein an included angle between the second connecting segment and the first connecting segment is a right angle.

12. The ALC batten mounting node structure of claim 1, wherein the connecting part is of a plate-like structure, and the first pipe clamp and the second pipe clamp are respectively connected onto plate surfaces at two sides of the connecting part.

* * * * *